US006575152B2

(12) United States Patent
Poggio et al.

(10) Patent No.: US 6,575,152 B2
(45) Date of Patent: Jun. 10, 2003

(54) METHOD FOR CONTROLLING THE TITRE OF THE EXHAUST GASES IN AN INTERNAL COMBUSTION ENGINE

(75) Inventors: Luca Poggio, Spinetta Marengo (IT); Daniele Ceccarini, Rimini (IT); Andrea Gelmetti, Bologna (IT)

(73) Assignee: Magneti Marelli, S.p.A., Milan (IT)

( * ) Notice: Subject to any disclaimer, the term of this patent is extended or adjusted under 35 U.S.C. 154(b) by 20 days.

(21) Appl. No.: 09/879,680

(22) Filed: Jun. 12, 2001

(65) Prior Publication Data

US 2002/0088447 A1 Jul. 11, 2002

(30) Foreign Application Priority Data

Jun. 13, 2000 (IT) ..... BO00A0349

(51) Int. Cl.[7] ..... F02D 41/14
(52) U.S. Cl. ..... 123/681; 123/687
(58) Field of Search ..... 123/674, 679, 123/681–684, 687, 696

(56) References Cited

U.S. PATENT DOCUMENTS 4,210,106 A 7/1980 Wessel et al. ..... 123/489
4,461,258 A 7/1984 Becker et al. ..... 123/440
5,492,106 A 2/1996 Sharma et al. ..... 123/681
5,787,867 A 8/1998 Schnaibel et al. ..... 123/674
6,360,733 B1 * 3/2002 Blotto et al. ..... 123/674
6,397,828 B2 * 6/2002 Poggio et al. ..... 123/673

FOREIGN PATENT DOCUMENTS

EP 0 952 322 10/1999

* cited by examiner

*Primary Examiner*—Tony M. Argenbright
(74) *Attorney, Agent, or Firm*—Baker & Daniels

(57) ABSTRACT

A method for controlling the titre of the exhaust gases in an internal combustion engine. An oxygen sensor provides a signal indicative of a titre (lambda) of the exhaust gases. The method includes selecting respective values of operating parameters on the basis of an objective lambda value and engine-related parameters, calculating a correction parameter on the basis of the respective values of the operating parameters and the lambda signal and calculating an adjustment quantity of fuel on the basis of the correction parameter and a nominal quantity of fuel. The method further includes selecting respective values of a first and a second of the operating parameters, determining magnitudes as a function of the respective values of the first and the second operating parameters and determining a third of the operating parameters as a function of the first and the second operating parameters and a mean value of the correction parameter.

8 Claims, 3 Drawing Sheets

METHOD FOR CONTROLLING THE TITRE OF THE EXHAUST GASES IN AN INTERNAL COMBUSTION ENGINE

The present invention relates to a method of controlling the titre of the exhaust gases in an internal combustion engine.

BACKGROUND OF THE INVENTION

As is known, control systems for the internal combustion engines currently commercially available make use of strategies which, by controlling the air-fuel ratio (A/F) of the mixture supplied to the engine, make it possible to minimise emissions of pollutant agents. Efficient removal of these pollutant agents depends in practice on the composition of the exhaust gases of the engine.

According to the strategies commonly used, a concentration signal supplied by an oxygen sensor, representative of the A/F ratio or, equivalently, of the exhaust titre of the engine, is used to determine the quantity of fuel to be supplied to this engine in order to obtain a desired titre. On the basis of the curve of the concentration signal and as a function of the operating conditions of the engine, a controller of proportional-integral type calculates a correction coefficient in order to modify a nominal quantity of fuel in order to make the mixture supplied to the engine richer or leaner. By selecting appropriate values of a plurality of integration and delay parameters of the proportional-integral controller, it is possible to cause the correction coefficient and therefore the exhaust titre to oscillate with a predetermined frequency about mean values having a desired curve.

The values of the integration and delay parameters, corresponding to different operating conditions and desired titre values, are normally determined empirically during the calibration stage and stored in large-dimension tables.

This is a drawback as in the known strategies the number of parameters used to calculate the correction coefficient is high and therefore requires considerable and expensive non-volatile memory space.

The known strategies make it possible, moreover, to act alternatively either solely on the integration parameters or solely on the delay parameters. In the first case, it is possible to obtain high frequencies of oscillation of the exhaust titre about the set mean value which cannot, however, depart greatly from a stoichiometric titre. In the second case, it is possible to obtain a more significant polarisation of the titre, but the frequency of oscillation about the mean value decreases.

SUMMARY OF THE INVENTION

The object of the present invention is to provide a method for controlling the air/fuel ratio in an internal combustion engine which makes it possible to remedy the above-described drawbacks.

The present invention therefore relates to a method for controlling the titre of the exhaust gases in an internal combustion engine, in a control system comprising a control unit and oxygen sensor means, disposed along an exhaust duct of the engine and supplying a signal indicative of a titre of gases present in this exhaust duct, the control unit comprising memory means, controller means and correction and actuation means, these memory means receiving as input a plurality of engine-related parameters and an objective titre value and supplying as output a plurality of operating parameters, the controller means receiving as input the operating parameters and the signal and supplying as output a correction parameter correlated with the operating parameters and the signal, the correction and actuation means receiving as input a nominal quantity of fuel and the correction parameter and supplying as output to the engine an adjusted quantity of fuel, the method comprising the stages of:

a) selecting respective values of the operating parameters on the basis of the objective titre value and the engine-related parameters;

b) calculating the correction parameter on the basis of the respective values of the operating parameters and the signal;

c) calculating the adjusted quantity of fuel on the basis of the correction parameter and the nominal quantity of fuel;

the method being characterised in that the selection stage is preceded by the stages of:

d) selecting respective values of a first and a second of the operating parameters;

e) determining magnitudes as a function of these respective values of the first and the second operating parameters;

f) determining a third of the operating parameters as a function of the first and the second operating parameter and a mean value of the correction parameter.

BRIEF DESCRIPTION OF THE DRAWINGS

The invention is described below in further detail with reference to a preferred embodiment thereof, given purely by way of non-limiting example and made with reference to the accompanying drawings, in which.

DETAILED DESCRIPTION OF THE INVENTION

Figure 1:
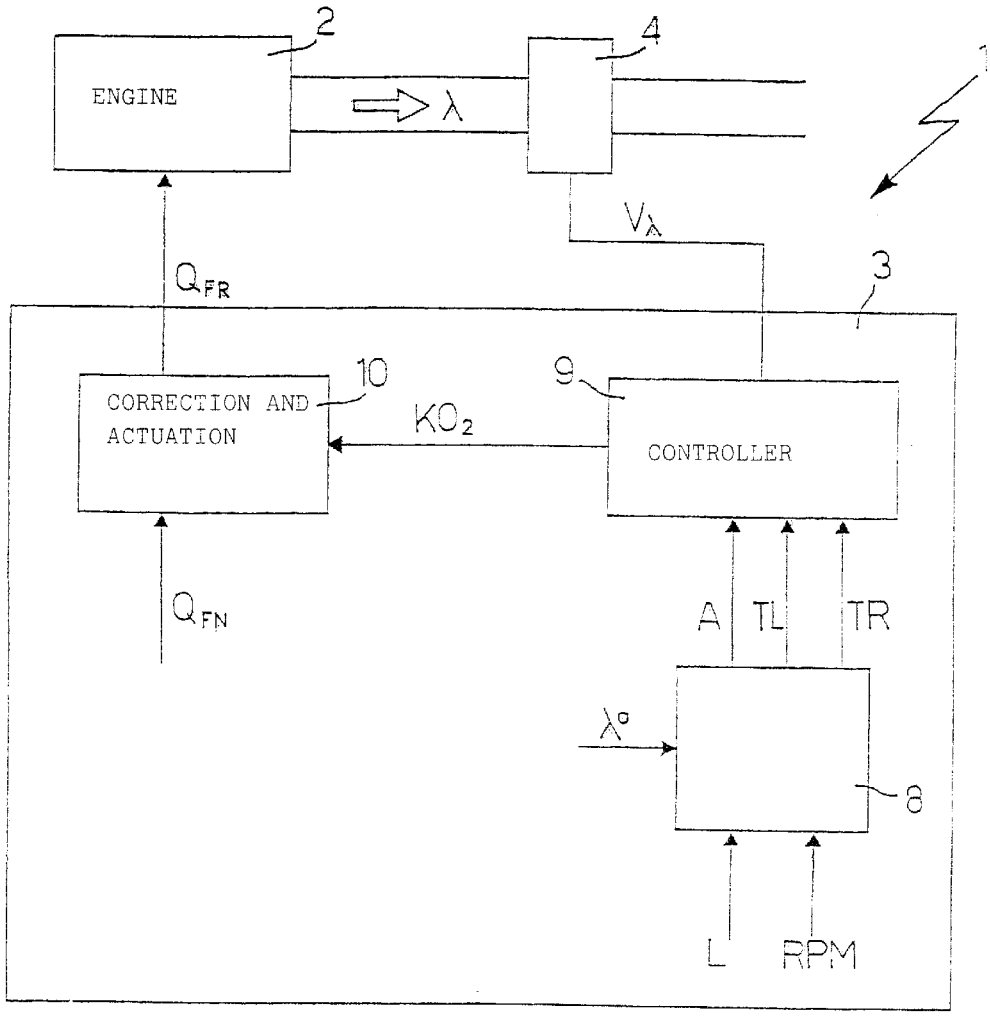
FIG. 1 is a block diagram of a control system for the air/fuel ratio of an internal combustion engine implementing the method of the present invention.
Figure 3:
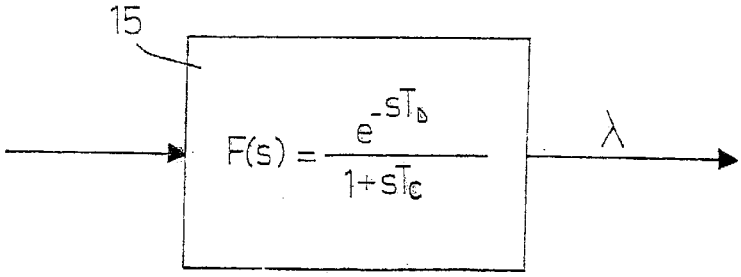
FIG. 3 is a block diagram of a dynamic system with respect to the system of FIG. 1.
Figure 2:
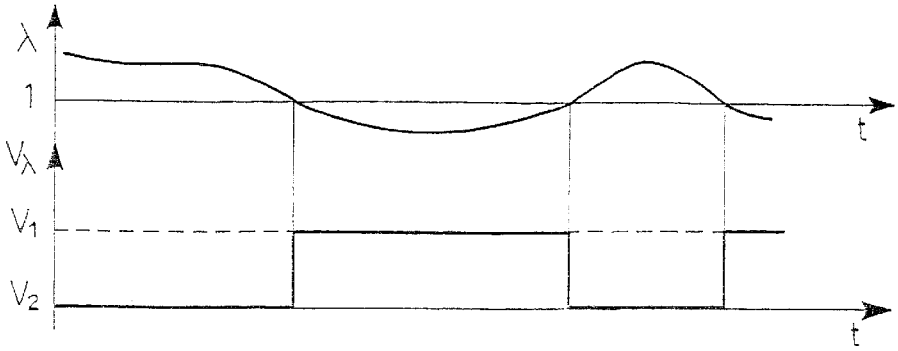
FIG. 2 shows curves of magnitudes in relation to the method of the present invention.

In FIG. 1, a system for controlling the exhaust titre of an internal combustion engine 2 is shown overall by 1. The system 1 comprises a control unit 3 and an oxygen sensor 4 disposed along an exhaust duct 5 of the engine 2 between this engine 2 and a catalyst 6. The oxygen sensor 4, preferably a LAMBDA probe of on/off type, is connected to the control unit 3 and supplies a concentration signal $V_\lambda$ representative of an oxygen titre in the exhaust gases from the engine 2. As shown in FIG. 2, the concentration signal $V_\lambda$, shown by a continuous line, assumes a first value $V_1$ in the presence of a rich mixture, i.e. having a titre $\lambda$ lower than 1 (the titre $\lambda$ is shown by a dashed line), and a second value $V_2$ in the presence of a lean mixture (i.e. having a titre $\lambda$ greater than 1).

The control unit 2 comprises a table 8, a controller 9 and a correction and actuation block 10.

The table 8, preferably stored in a non-volatile memory (not shown), receives as input a plurality of engine-related parameters including a load L and a number of revolutions RPM, and an objective titre value λ° (selected, for instance, from a further table also contained in the non-volatile memory and not shown) and supplies the controller 9 with a plurality of operating parameters, including an inclination A, an enrichment delay TR and a depletion delay TL (the meaning of these operating parameters will be explained below).

The controller 9, preferably of proportional-integral type, has an input connected to the oxygen sensor 4, in order to receive the concentration signal $V_\lambda$, and an output connected to the correction and actuation block 10 and supplying a correction parameter KO2. In practice, the controller 9 and the table 8 form a control block 12.

The correction and actuation block 10 receives as input a current value of a nominal quantity of fuel $Q_{FN}$ (selected from a further table also contained in the non-volatile memory or calculated on the basis of a model of the engine 2) and is in turn connected to the engine 2 to which it supplies an adjusted quantity of fuel $Q_{FR}$, given for instance by the ratio between the nominal quantity of fuel $Q_{FN}$ and the correction parameter KO2.

During the operation of the engine 2, the control action exerted by the controller 9 depends on the values of the operating parameters (inclination A, enrichment delay TR and depletion delay TL) which are selected from the table 8, as a function of respective values of the objective titre λ°, the load L and the number of revolutions RPM. In particular, the controller 9, on the basis of the value of the concentration signal $V_\lambda$, imposes a desired curve on the correction parameter KO2, such that the titre of the exhaust gases is close to the objective titre λ°.

As shown in FIG. 2, the relationship between the correction parameter KO2 and the titre may be approximated by means of a dynamic system 15 having a transfer function F(s) given by the expression:

$$F(s)=e^{-sTD}/1+sT_C \quad (1)$$

in which s is a complex variable, $T_C$ is a time constant dependent on the constructional characteristics of the engine 2 and the response time of the oxygen sensor 4 and $T_D$ is a transport delay of the exhaust gases. Both the time constant $T_C$ and the transport delay $T_D$ can be determined experimentally.

In an equivalent manner, the relationship between the correction parameter KO2 and the titre may be expressed, in the time domain t, by the following differential equation:

$$d\lambda(t)/dt+1/T_C\lambda(t)=1/T_C KO2(t-T_D) \quad (2)$$

As is evident from expression (1), the system 15 has a unit gain and therefore the mean values of the correction parameter KO2 and the titre λ are equal. Consequently, in order to set the titre λ to a desired mean value (i.e. the objective titre value λ°), it is sufficient to set the correction parameter KO2 to the same mean value.

This may be obtained by selecting appropriate respective values of the inclination A, the enrichment delay TR and the depletion delay TL, in order to modify the action of the controller 9, as will now be explained with reference to FIGS. 4 to 6 which show three examples of wave shapes of the correction parameter KO2.

Figure 4:
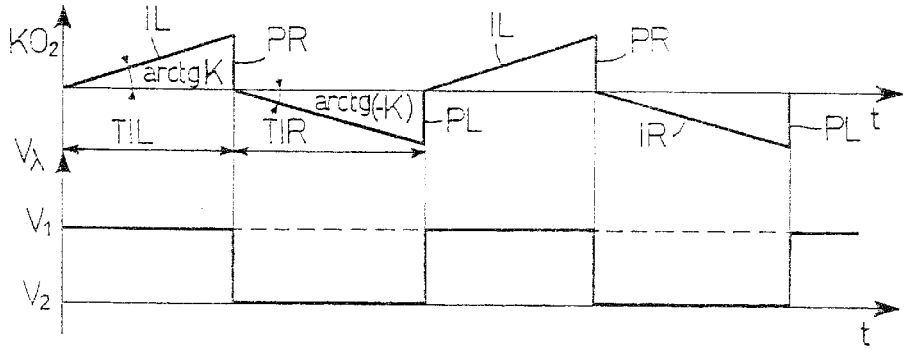
FIGS. 4 to 6 shows curves of further magnitudes in relation to the method of the present invention.

The example of FIG. 4 corresponds in particular to a case in which the objective titre value λ° is unitary. The curve of the correction parameter KO2 has proportional enrichment PL and depletion PR jumps and integral depletion IL and enrichment IR sections having an equal gradient as an absolute value (equal to an angular coefficient K). The integral depletion IL and enrichment IR sections have a duration equal to a depletion integration time TIL and an enrichment integration time TIR respectively, whose sum is equal to twice the transport delay $T_D$; moreover, the proportional depletion PL and enrichment PR jumps coincide with the switching of the concentration signal $V_\lambda$. The inclination A represents a gradient variation of the integral depletion IL and enrichment IR sections with respect to the angular coefficient K; the enrichment delay TR and the depletion delay TL represent delays in the actuation of the proportional enrichment PR and depletion PL jumps with respect to the switching of the concentration signal $V_\lambda$. In the case in which the objective titre value λ° is unitary, the inclination A, the enrichment delay TR and the depletion delay TL are zero.

Figure 5:
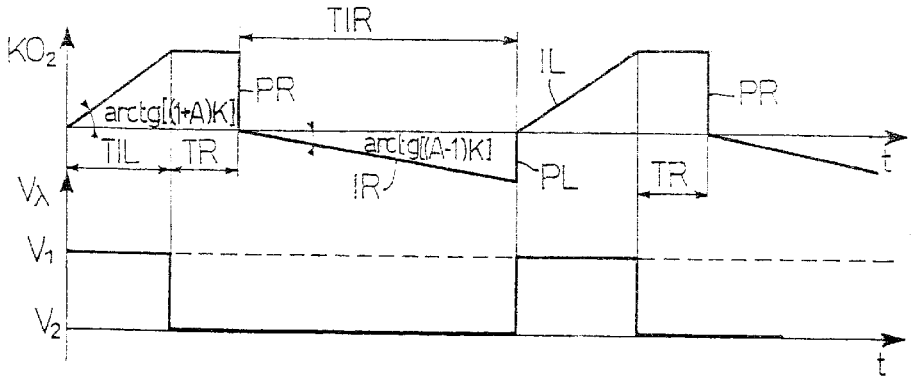
Figure 6:
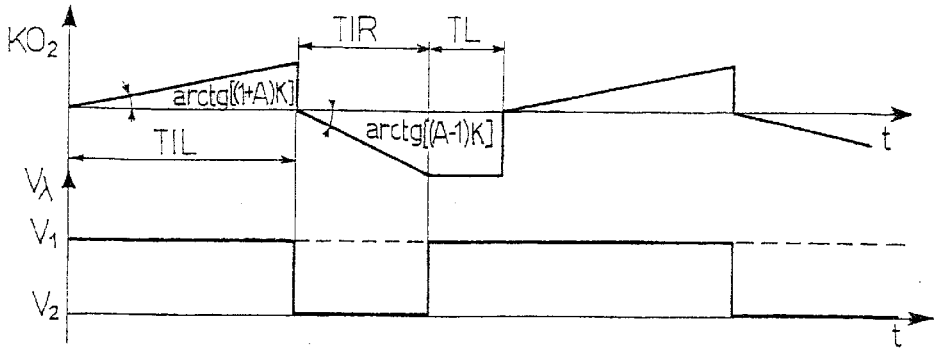

FIG. 5 shows a case in which the objective titre λ° is greater than 1, i.e. it is desired to obtain a lean mixture. It is therefore necessary to modify the operating parameters of the controller 9 to obtain a mean value of the correction parameter KO2 greater than 1. In particular, a positive value of the inclination A is selected and used to obtain a gradient of the integral depletion section IL given by the expression:

$$(A+1)K \quad (3)$$

and a gradient of the integral enrichment section IR given by the expression:

$$(A-1)K \quad (4)$$

In this way, the gradient of the integral depletion section IL is greater, as an absolute value, than the gradient of the integral enrichment section IR. In this case as well, the sum of the depletion integration and enrichment integration times TIL and TIR is equal to twice the transport delay $T_D$.

The depletion delay TL is set to zero. A zero value is allocated to the enrichment delay TR, if, in order to reach the objective titre value λ° selected, it is sufficient to set a value of the inclination A lower than a predetermined threshold AS, or a positive value in the opposite case.

In the example of FIG. 5, the objective titre value λ° is lower than 1. In this case, a negative value of the inclination A is selected and used to modify the gradients of the integral depletion IL and enrichment IR sections according to expression (3) and respectively expression (4). In this way, the gradient of the integral depletion section IL is lower, as an absolute value, than the gradient of the integral enrichment section IR. In this case as well, the sum of the depletion integration TIL and enrichment integration TIR times is equal to twice the transport delay $T_D$.

The enrichment delay TR is set to zero. A zero value is allocated to the depletion delay TL, if, in order to reach the objective titre value λ° selected, it is sufficient to set a value of the inclination A lower (as an absolute value) than a predetermined threshold AS; otherwise the depletion delay TL is set to a positive value.

It will be appreciated that the depletion integration time TIL and the enrichment integration time TIR, i.e. the time between the beginning of each integral section and the successive switching of the concentration signal $V_\lambda$, depend on the response of the dynamic system 15 of FIG. 2 according to the transfer function F(s) or, as an equivalent, to the differential equation (2). Consequently, once the values of the inclination A, the enrichment delay TR and the depletion delay TL have been selected, in order to be able to calculate the curve and the mean value of the correction parameter KO2, it is necessary to calculate the response of the dynamic system 15, by integrating the differential equation (2) in an evident manner to a person skilled in the art.

It is also possible to set respective values of two of the three operating parameters of the controller 9 (inclination A, enrichment delay TR and depletion delay TL) and to calculate the third in order to determine a desired mean value of the correction parameter KO2.

For instance, respective values of the enrichment delay TR and the depletion delay TL are initially set. On the basis of these set values, the response of the dynamic system 15 (i.e. the curve of the titre λ) is calculated as a function of the inclination A, making it possible to determine, again as a function of the inclination A, switching moments TC of the concentration signal $V_\lambda$ and therefore the depletion integration time TIL and the enrichment time TIR. It is therefore possible to obtain, in a manner known per se, an expression of the mean value of the correction parameter KO2 in which the only unknown magnitude is the inclination A. The mean value of the correction parameter KO2 is therefore set to be equal to the objective titre value λ° and the value of the inclination A that is needed to obtain this desired mean value is then calculated.

Similarly, it is possibly initially to set the inclination A and the enrichment delay TR and to calculate the depletion delay TL, or it is possible initially to set the inclination A and the depletion delay TL and to calculate the enrichment delay TR.

Figure 7:
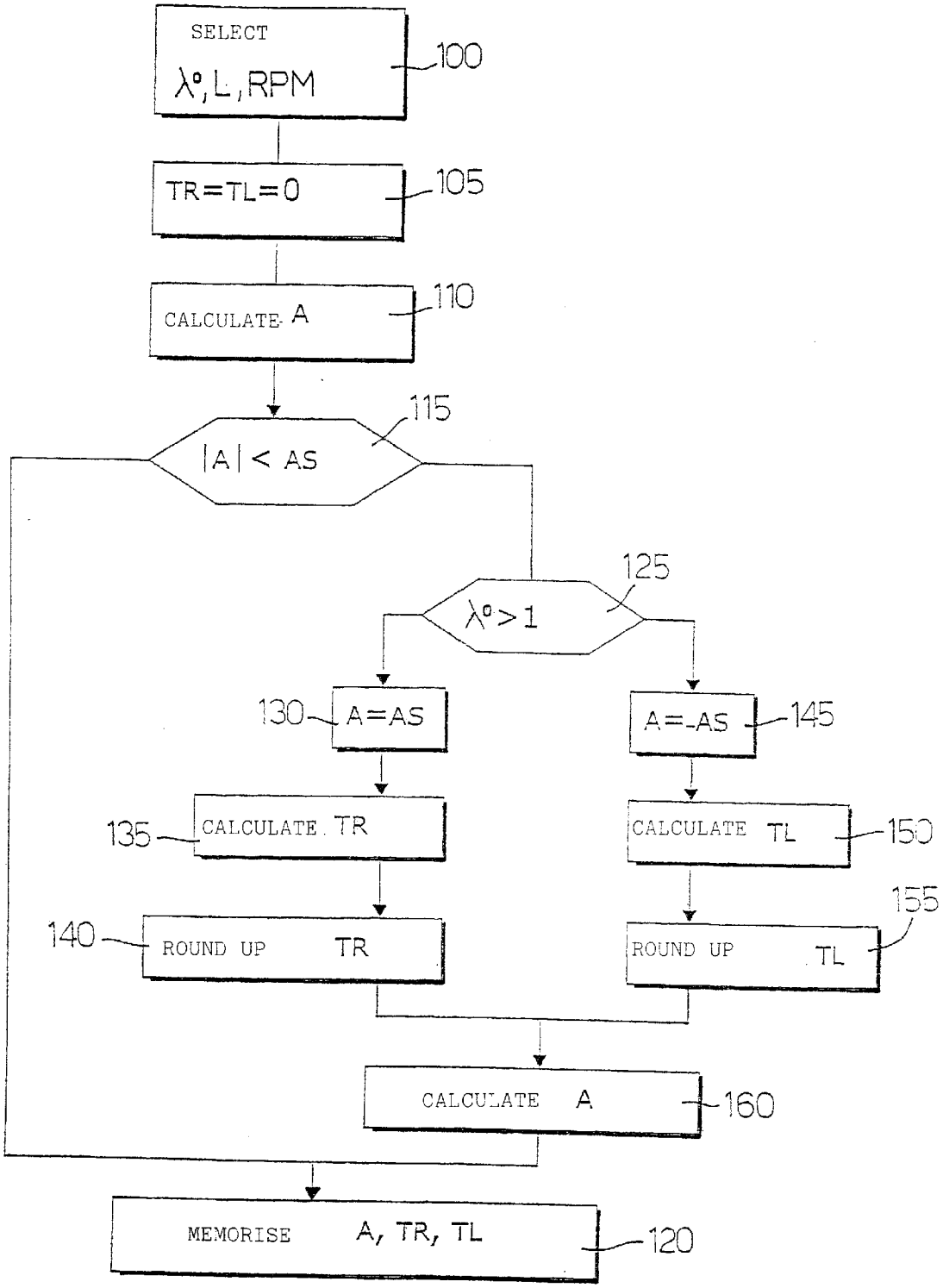
FIG. 7 is a flow diagram of the method of the present invention.

The values of the inclination A, the enrichment delay TR and the depletion delay TL as a function of the objective titre λ° and of the operating conditions of the engine 2 (load L and number of revolutions RPM) are calculated using a procedure that will be described below with reference to FIG. 7.

Values of the load L and the number of revolutions RPM, defining an engine point, and an objective titre value λ°, are initially set (block 100).

The enrichment delay TR and the depletion delay TL are then set to zero (block 105) and the value of the inclination A needed to obtain the mean value of the control parameter KO2 and the desired objective titre λ° are calculated (block 110). The inclination A is calculated in the manner described above.

A test is then conducted to evaluate whether the absolute value of the inclination A calculated is lower than the threshold AS (block 115).

If so (output YES from block 115), the values of the inclination A, the enrichment delay TR and the depletion delay TL are memorised (block 120).

Otherwise (output NO from block 115), a further test is carried out to detect whether the objective titre value λ° currently set is greater than 1 (block 125).

If this is so (output YES from block 125), the inclination A is set to the threshold AS (A=+AS, block 130) and, maintaining the depletion delay TL at zero, the value of the enrichment delay TR is calculated (block 135). Given that the reference time unit is taken as the period between two successive instants in which a cylinder of the engine 2 is at the top dead centre, the enrichment delay TR is then rounded up to an entire multiple of the period between two successive top dead centres (block 140).

If, however, the objective titre value λ° currently set is lower than 1 (output YES from block 125), the inclination A is set to the opposite of the threshold AS (A=−AS, block 145) and, maintaining the enrichment delay TR at zero, the value of the depletion delay TL is calculated (block 150). The depletion delay TL is then rounded up to an entire multiple of the period between two successive top dead centres (block 155).

It will be appreciated that, each time that the procedure is performed, a non-zero value is calculated only for the enrichment delay TR or the depletion delay TL and the other remains set to the zero value initially set (block 105).

Thereafter, the value of the inclination A is re-calculated on the basis of the values of the enrichment delay TR and the depletion delay TL previously obtained (block 160).

Lastly, the values of the inclination A and the enrichment delay TR and the depletion delay TL are memorised in the table 8 (block 120).

The advantages of the present method can be readily deduced from the above description.

In the first place, it is possible to obtain an economic advantage in comparison with conventional methods, as it is necessary to memorise a smaller number of parameters. Less non-volatile memory space is therefore required. The method also provides a criterion for modifying the control action on the titre by acting at the same time on the integration and delay parameters. In calculating the operating parameters of the controller, priority is in practice given to action on the inclination A (integration) and there is action on the enrichment delay TR and the depletion delay TL only to avoid excessive distortions of the wave shape of the correction parameter KO2 (i.e. when the inclination A is greater, as an absolute value, than the threshold AS). In particular, the method makes it possible to set high deviations of the objective titre λ from the unitary value, without significantly diminishing the frequency of oscillation of this titre about the objective value λ°.

It will be appreciated that modifications and variations that do not depart from the scope of protection of the present invention may be made to the method as described.

What is claimed is:

1. A method for controlling the titre of the exhaust gases in an internal combustion engine (2), in a control system (1) comprising a control unit (3) and oxygen sensor means (4), disposed along an exhaust duct (5) of the engine (2) and supplying a signal ($V_\lambda$) indicative of a titre (λ) of gases present in this exhaust duct (5), the control unit comprising memory means (8), controller means (9) and correction and actuation means (10), these memory means receiving as input a plurality of engine-related parameters (L, RPM) and an objective titre value (λ°) and supplying as output a plurality of operating parameters (TR, TL, A), the controller means (9) receiving as input the operating parameters (TR, TL, A) and the signal ($V_\lambda$) and supplying as output a correction parameter (KO2) correlated with the operating parameters (TR, TL, A) and the signal ($V_\lambda$), the correction and actuation means (10) receiving as input a nominal quantity of fuel ($Q_{FN}$) and the correction parameter (KO2) and supplying as output to the engine (2) an adjusted quantity of fuel ($Q_{FR}$), the method comprising the stages of:

a) selecting respective values of these operating parameters (A, TR, TL) on the basis of the objective titre value (λ°) and the engine-related parameters (L, RPM);

b) calculating the correction parameter (KO2) on the basis of the respective values of the operating parameters (TR, TL, A) and the signal ($V_\lambda$);

c) calculating the adjusted quantity of fuel ($Q_{FR}$) on the basis of the correction parameter (KO2) and the nominal quantity of fuel ($Q_{FN}$);

the method being characterised in that the selection stage a) is preceded by the stages of:

d) selecting (105) respective values of a first and a second of the operating parameters (TR, TL);

e) calculating time magnitudes (TIL, TIR) as a function of a third of the operating parameters (A) in the presence of the respective selected values of the first and second operating parameters (TR, TL);

f) determining (110) the third operating parameter (A) as a function of the first and second operating parameters selected (TR, TL) and a mean value of the correction parameter (KO2).

2. A method as claimed in claim 1, characterised in that the stage e) comprises the stage of:

e1) determining a solution of the equation:

$$d\lambda(t)/dt+1/T_C\lambda(t)=1/T_C KO2(t-T_D)$$

in which t is a time variable, $T_C$ is a time constant and $T_D$ is a transport delay.

3. A method as claimed in claim 1, characterised in that it comprises the stages of:

h) verifying (115) whether the third operating parameter (A) is lower than a predetermined threshold (AS);

i) memorising (120) the first, second and third operating parameters, if the third operating parameter (A) is lower than the predetermined threshold (AS).

4. A method as claimed in claim 3, characterised in that the stage h) of verifying (115) whether the third operating parameter (A) is lower than the predetermined threshold (AS), when this third operating parameter (A) is greater than this predetermined threshold (AS), is followed by the stages of:

j) setting the third parameter (A) to the predetermined threshold (AS) if the objective titre value (λ°) is greater than 1 (125, 130);

k) setting the third parameter (A) to a value opposite to the predetermined threshold (AS) if the objective titre value (λ°) is lower than 1 (125, 145).

5. A method as claimed in claim 4, characterised in that the stage j) of setting the third parameter (A) to the predetermined threshold (AS) if the objective titre value (λ°) is greater than 1 (125, 130) is followed by the stages of:

l) calculating (135) the first operating parameter (TR) as a function of the second and third operating parameters (TL, A);

m) rounding this first operating parameter (TR) up to a multiple of a period between successive top dead centres (140).

6. A method as claimed in claim 4, characterised in that the stage k) of setting the third parameter (A) to a value opposite to the predetermined threshold (AS) if the objective titre value (λ°) is lower than 1 (125, 145), is followed by the stages of:

n) calculating (150) the second operating parameter (TL) as a function of the first and third operating parameters (TR, A);

o) rounding this second operating parameter (TL) up to a multiple of a period between successive top dead centres (155).

7. A method as claimed in claim 6, characterised in that it comprises the stage of:

p) re-calculating (160) this third operating parameter (A) as a function of the first and second operating parameters (TR, TL).

8. A method as claimed in claim 7, characterised in that the stage p) of re-calculating (160) this third operating parameter (A) is followed by the stage of q) memorising these first, second and third operating parameters (TR, TL, A).

* * * * *